US005669088A

United States Patent [19]

McNamee

[11] Patent Number: 5,669,088

[45] Date of Patent: Sep. 23, 1997

[54] INFLATABLE SLEEPING ENCLOSURE

[76] Inventor: Brian J. McNamee, P.O. Box 676, Severna Park, Md. 21146

[21] Appl. No.: 661,957

[22] Filed: Jun. 12, 1996

[51] Int. Cl.[6] ..... A47G 9/08

[52] U.S. Cl. ..... 5/413 AM; 5/414; 135/56; 135/116

[58] Field of Search ..... 5/413 R, 413 AM, 5/414; 135/96, 116, 124–127, 115

[56] References Cited

U.S. PATENT DOCUMENTS

| | | | |
|---|---|---|---|
| 867,464 | 10/1907 | Abbott . | |
| 1,648,373 | 11/1927 | Vilas . | |
| 2,284,900 | 6/1942 | Henderson et al. . | |
| 2,341,069 | 2/1944 | Anderson | 5/413 R |
| 2,637,048 | 5/1953 | Peters et al. | 5/413 R |
| 2,875,771 | 3/1959 | Brewin . | |
| 3,751,741 | 8/1973 | Hendry | 5/413 AM |
| 3,798,686 | 3/1974 | Gaiser . | |
| 3,840,919 | 10/1974 | Middleton | 135/96 X |
| 3,935,690 | 2/1976 | Lea et al. . | |
| 4,000,585 | 1/1977 | Denaro . | |
| 4,000,749 | 1/1977 | Busco . | |
| 4,091,482 | 5/1978 | Malcolm . | |
| 4,092,750 | 6/1978 | Ellis . | |
| 4,301,791 | 11/1981 | Franco, III . | |
| 4,531,330 | 7/1985 | Phillips | 135/116 X |
| 4,607,655 | 8/1986 | Wagner et al. | 135/116 X |
| 4,719,935 | 1/1988 | Gustafson | 135/124 |
| 4,757,832 | 7/1988 | Russell . | |
| 4,787,105 | 11/1988 | Phillips et al. | 5/413 R |
| 4,862,533 | 9/1989 | Adams, III . | |
| 4,896,387 | 1/1990 | Malcolm et al. . | |
| 5,005,236 | 4/1991 | Hutchinson . | |
| 5,458,146 | 10/1995 | Gregg | 5/413 R X |
| 5,502,927 | 4/1996 | Hammerton | 135/124 X |

FOREIGN PATENT DOCUMENTS 1535316 12/1978 United Kingdom .

*Primary Examiner*—Michael F. Trettel

*Attorney, Agent, or Firm*—Morton J. Rosenberg; David I. Klein

[57] ABSTRACT

A sleeping bag enclosure (10, 10', 100, 200, 200') is provided which includes an envelope (20, 20', 120, 220, 220') extending longitudinally from a closed end (26, 126, 226) to an open end (28, 128, 228). The sleeping bag enclosure (10, 10', 100, 200, 200') further includes a vented cover member (40, 40', 240) secured to the open end (28, 128, 228) of envelope (20, 20', 120, 220, 220') for forming a closure therefor. Vented cover member (40, 40', 240) includes a plurality of ventilation openings (42, 242) formed therethrough to allow air to be exchanged between the external environment and an internal space (34). The internal space (34) is maintained in an open condition to allow the user to be comfortably enclosed within the space (34).

19 Claims, 5 Drawing Sheets

INFLATABLE SLEEPING ENCLOSURE

BACKGROUND OF THE INVENTION

1. Field of the Invention

This invention directs itself to sleeping bag structures. In particular, this invention directs itself to a sleeping bag structure in which the user can be totally enclosed therein. Further, the sleeping bag enclosure of this invention includes means for maintaining the interior space thereof in an open condition. More in particular, embodiments of this invention maintain the interior space of the sleeping bag enclosure in an open condition by means of a plurality of longitudinally extending air passages, each inflatable through a respective air valve. Additionally, this invention relates to a sleeping bag construction which provides the use of air compartments as a thermal insulating structure for maintaining an enclosed user in a thermally comfortable environment with respect to the external thermal environment. In other embodiments, this invention maintains the interior space open by means of transversely directed support members. In particular, such support members are formed by transversely directed air passages, each inflatable to a respective air valve.

2. Prior Art

Sleeping bag enclosures and inflatable sleeping bags are well known in the art. The best known prior art to the Applicant include U.S. Pat. Nos. 4,896,387; 4,091,482; 3,935,690; 4,301,791; 5,005,236; 4,092,750; 867,464; 1,648,373; 4,000,749; 4,862,533; 2,284,900; 3,798,686; 4,757,832; 4,000,585; 2,875,771; and, 3,935,690, and Great Britain Patent No. 1535316.

In some prior art systems, such as that disclosed in U.S. Pat. No. 4,896,387, sleeping bags having inflatable upper and lower components are disclosed. However, the upper and lower components, although inflatable, are separate and distinct elements which are releasably coupled together. Further, such systems provide thermal insulation within the inflation space without any intervening layers between the air impervious inner skin and the user. However, such systems do not disclose any means for enclosing the head supporting region of the sleeping bag.

In other prior art systems, such as that disclosed in U.S. Pat. Nos. 867,464 and 1,648,373, inflatable sleeping bag structures are disclosed. Although such systems provide covering portions which may overlay the user's head to thereby enclose the user, such systems do not incorporate any structural means for supporting the upper portion of the sleeping bag over the user. In particular, such systems do not disclose the use of inflatable air passages for providing structural support to maintain the sleeping bag enclosure in an open condition.

SUMMARY OF THE INVENTION

A sleeping bag enclosure is provided which includes a longitudinally extended outer envelope open on one end and having an upper side and a lower side. The upper side of the outer envelope has an inner wall and an outer wall formed of an air impervious material joined together to form a plurality of air passages therebetween to maintain the outer envelope in an open condition. The lower side of the outer envelope is formed by a second outer wall. The sleeping bag enclosure further includes an insulating inner envelope open on one end and concentrically disposed within the outer envelope. The inner envelope has an upper side secured to the inner wall of the outer envelope and a lower side secured to the second outer wall of the outer envelope. The sleeping bag enclosure includes a vented cover member coupled to the outer wall of the outer envelope on a perimeter of the open end for forming a closure therefor.

It is an object of the present invention to provide a sleeping bag enclosure wherein the user's internal sleeping space is maintained in an open condition.

It is another object of the present invention to provide a sleeping bag enclosure having inflatable air passages formed along an upper side thereof to provide sufficient structural support to maintain the internal space in an open condition.

It is still another object of the present invention to provide a sleeping bag enclosure having a vented cover member with openings formed therethrough for allowing the free exchange of air between the ambient environment external to the sleeping bag enclosure and the internal sleeping space of the sleeping bag enclosure.

It is yet another object of the present invention to provide a sleeping bag enclosure having a vented cover member where a folded portion thereof forms an overhang for the plurality of ventilation through openings formed therein.

DESCRIPTION OF THE PREFERRED EMBODIMENTS

Figure 1:
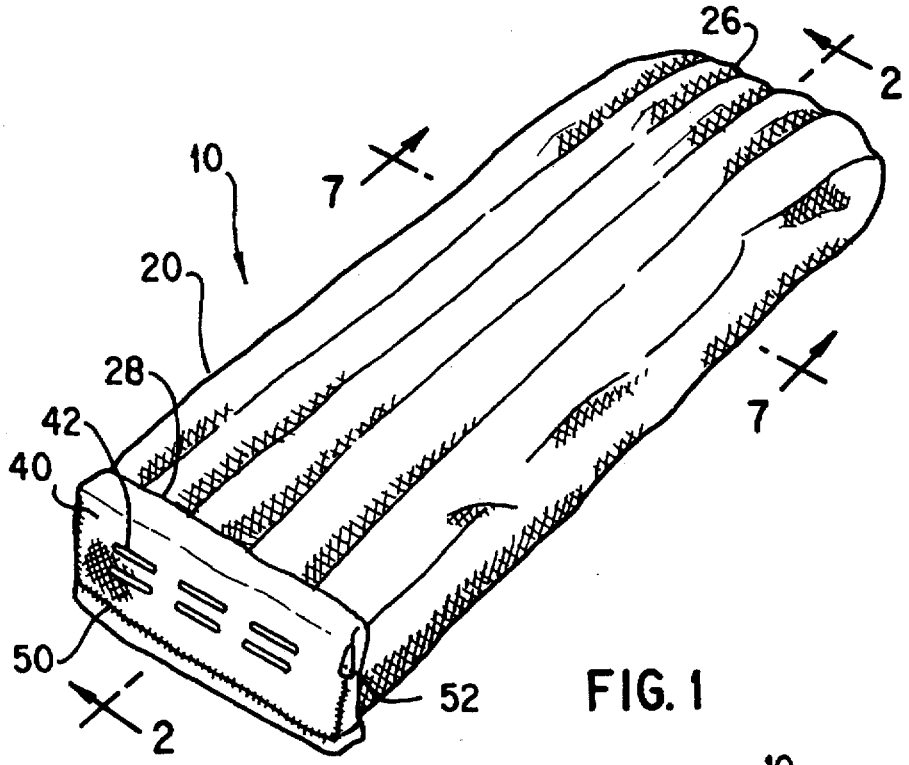
FIG. 1 is a perspective view of the sleeping bag enclosure of the present invention.

Referring now to FIGS. 1–16, there is shown, sleeping bag enclosure 10, 10', 100, 200, 200', for providing a lightweight sleeping bag system for totally enclosing a user. As will be seen in following paragraphs, sleeping bag enclosure 10, 10', 100, 200, 200' is specifically directed to the concept of providing a lightweight transportable sleeping bag system having an envelope 20, 20', 120, 220, 220' defining an open interior chamber or space 34, whereby the user's entire body may be disposed within the envelope. Although not restricted to one particular structure for maintaining the envelope in an open condition, sleeping bag enclosures 10, 10', 100 and 200' are particularly directed to the concept of utilizing pressurized air passages or inflatable members to provide the necessary structural support to maintain an interior space 34 within the enclosure in an open condition. Additionally, the open end of the envelope is provided with a vented closure 40, 40', 240, for isolating the user from the external environment weather conditions, while still permitting circulation of air within the enclosure.

As shown in FIG. 1, the sleeping bag enclosure 10 includes an outer envelope 20 that extends longitudinally between a closed end 26 and an open end 28. A vented cover member 40 provides a closure for the open end 28. Vented cover member 40 includes a plurality of ventilation through openings or slits 42 through which air may be exchanged between the ambient environment and the interior of sleeping bag enclosure 10. Vented cover member 40 is secured to envelope 20, such securement being releasable on at least three sides to the envelope 20. The releasable securement of vented cover member 40 may be by means of a zipper type fastener 50 which is operated by a zipper pull 52 on the exterior, and a like device disposed on the interior side of cover 40.

Figure 2:
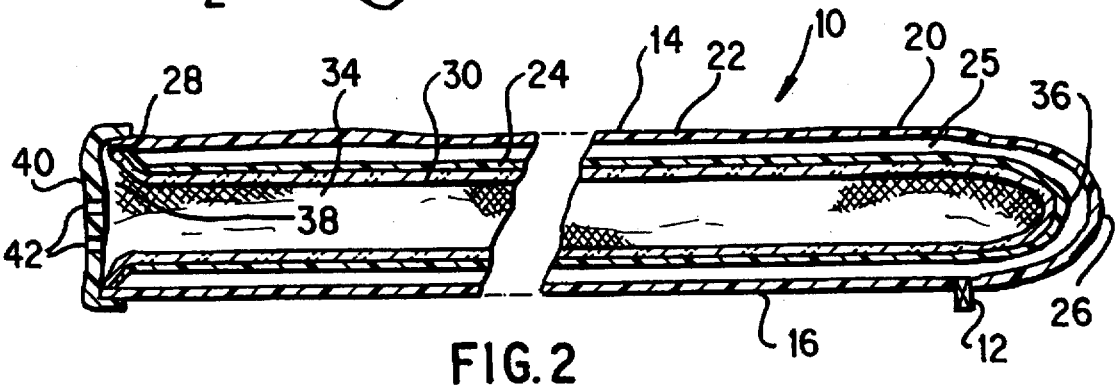
FIG. 2 is a cross-sectional view of the present invention taken along the section line 2—2 of FIG. 1.

The structure of sleeping bag enclosure 10 is best seen in FIG. 2, the structure being multilayered, with the outer envelope 20 being formed by an outer wall 22 and an inner wall 24 disposed in spaced relationship therewith. The outer wall 22 and inner wall 24 are joined together at spaced locations to form a plurality of spaces 25 between outer wall 22 and inner wall 24. Each of the plurality of spaces 25 defines an air passage which may be inflated or deflated through a conventional inflation valve 12 essentially defining a commercially available check valve mechanism. Sleeping bag enclosure 10 further includes an inner envelope 30 disposed in concentric relationship with envelope 20. Envelope 30 is formed by a sheet of insulating material 32 bonded to the interior facing surface of inner wall 24. Inner envelope 30 includes a closed end 36 and a longitudinally displaced open end 38, the interior space 34 of inner envelope 30 defining the sleeping space for the user, with the vented cover member 40 forming a closure therefor.

Figure 7:
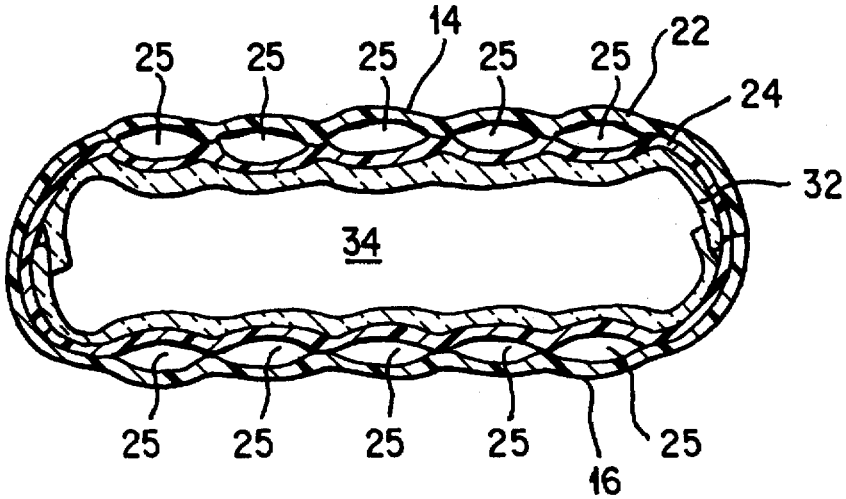
FIG. 7 is a transverse cross-sectional view of the first embodiment of the present invention taken along the section line 7—7 of FIG. 1.

As shown in FIG. 7, outer wall 22 and inner wall 24 are bonded together at a plurality of locations spaced transversely with respect to the longitudinal direction to form a plurality of separate and distinct air passages 25. Each of the separate air passages 25 extend longitudinally across both the upper side 14 and lower side 16 of the outer envelope 20. By this arrangement where the air passages 25 extend around the closed end of envelope 20, the pressurized air spaces 25 provides a rigidifying effect, exerting an upward force, to maintain the outer envelope 20 in an expanded, interior space defining open condition. As the insulating material 32 of the inner envelope 30 is bonded to the inner wall 24 of outer envelope 20, the envelope 30 is also maintained in an expanded, open condition. This open condition of the interior sleeping space 34 allows the user to occupy the interior space 34 with a free space being maintained over the user's head, thereby making it comfortable for the user to be totally enclosed within sleeping bag 10.

The portion of the pressurized air passages 25 disposed on the lower side 16 of envelope 20 provide the advantage of making sleeping bag enclosure 20 more comfortable, providing an air mattress-type sleeping pad and adding to the thermal insulation quality of the lower side 16 of the sleeping bag enclosure.

Subsequent to use, air may be removed from each of the plurality of air spaces 25 through a respective plurality of valves 12 which are coupled to the outer wall 22 and respectively disposed in fluid communication with the respective air passages. By maintaining each of the plurality of air spaces 25 in isolation from each other, each having its own valve 12, provides redundancy. Thus, if the integrity of one of the air passages is lost, as by means of a puncture through either of the walls 22, 24, then the remaining passages would still function as previously described. However, if such redundancy was not desired, then the plurality of air passages may be interconnected at the ends thereof or at any other convenient location, or a singular large air passage could likewise be utilized.

Figure 3:
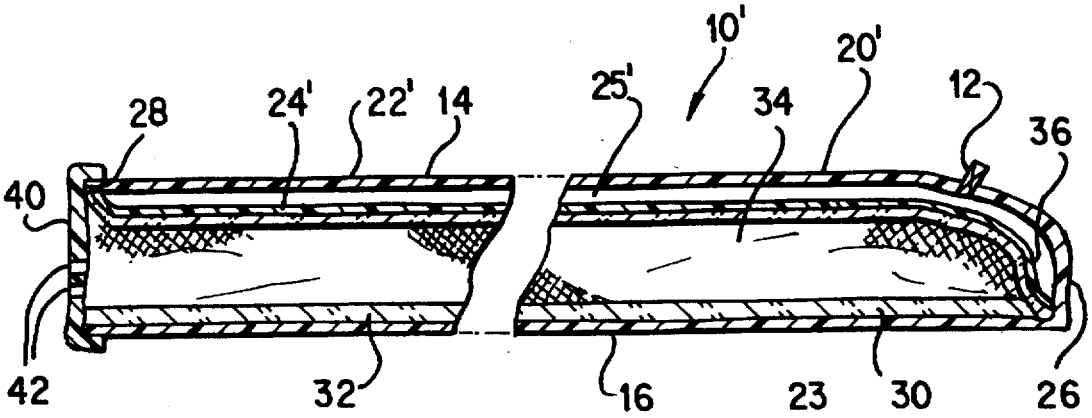
FIG. 3 is a cross-sectional view of an alternate embodiment of the present invention taken along the section line 2—2 of FIG. 1.
Figure 10:
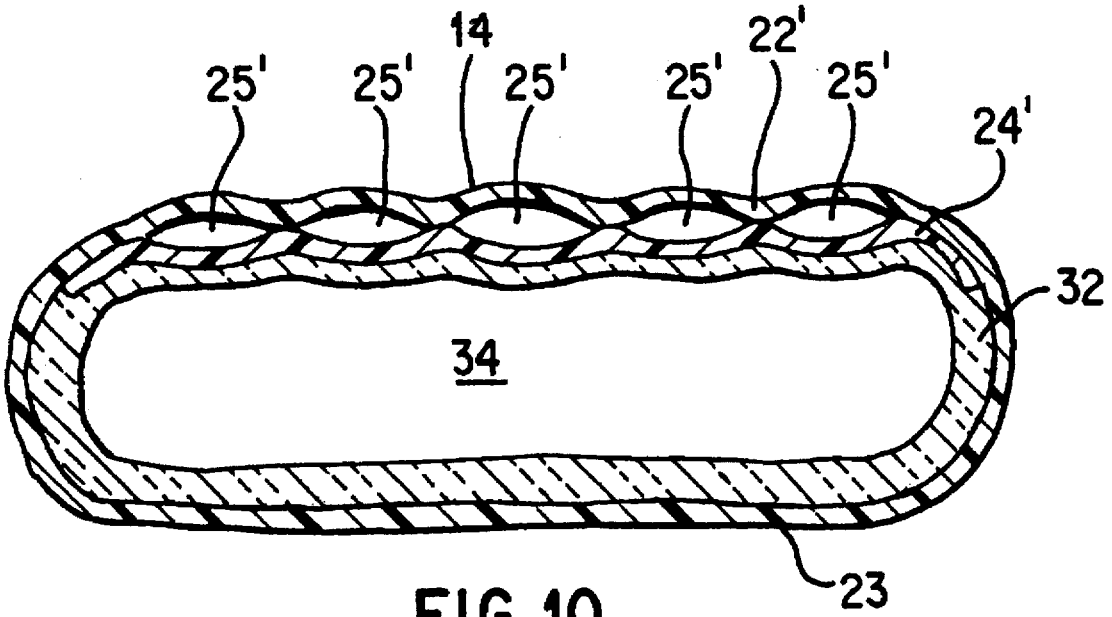
FIG. 10 is a transverse cross-sectional view of the embodiment of FIG. 3 taken along the section line 7—7 of FIG. 1.

Referring now to FIGS. 3 and 10, there is shown, an alternate embodiment of the instant invention. Sleeping bag enclosure 10' is designed to provide a sleeping enclosure which is lighter and stores in a more compact form than that for the embodiment of FIGS. 2 and 7. Sleeping bag enclosure 10' includes an outer envelope 20' formed by an outer wall 22 on the upper side 14 of envelope 20' and an outer wall 23 disposed on the lower side 16. The lower outer wall 23 may in fact be an extension of the upper wall 22, or a separate piece of sheet material joined thereto. Envelope 22' further includes an inner wall 24' which extends across the upper side 14 of envelope 20' from the open end 28 to the closed end 26, to a point adjacent the intersection of outer walls 22 and 23. Inner wall 24' extends transversely across the upper side 14 and may extend further, across the sides of envelope 20' to the lower periphery of the lower side 16, if desired. Sleeping bag enclosure 10' further includes an inner envelope 30 concentrically disposed within envelope 20' and formed by an insulating sheet material 32 bonded to the interior facing surface of inner wall 24' along the upper portion thereof, and bonded to the interior facing surface of the lower outer wall 23 along the lower portion thereof. Inner envelope 30, as in the previous embodiment, includes a closed end 36 and an open end 38. The co-terminal open ends of envelopes 20' and 30 are closed by means of a vented cover member 40 having a plurality of ventilation through openings 42 formed therethrough for permitting an air exchange between the ambient or external environment and the interior space 34 of sleeping bag enclosure 10'.

As shown in FIG. 10, the upper outer wall 22 is bonded to the inner wall 24 at a plurality of locations spaced transversely with respect to the longitudinal extension of the enclosure to form a plurality of separate and distinct air passages 25'. Each of the air passages 25' is pressurized by means of a respective conventional type air valve secured through the outer wall 22'. As the air passage extends around the closed end 26, pressurization of the air passage 25' causes an outward force to be exerted on the upper side of envelope 20', the pressurization creating a force that would tend to straighten the respective air passage, thereby maintaining the envelope 20' in an expanded or open condition. As the upper side of inner envelope 30 is bonded to the inner wall 24' of outer envelope 20', such is also maintained in an expanded or open condition by the pressurization of the plurality of air passages 25', providing an open interior sleeping space or chamber 34.

Figure 4:
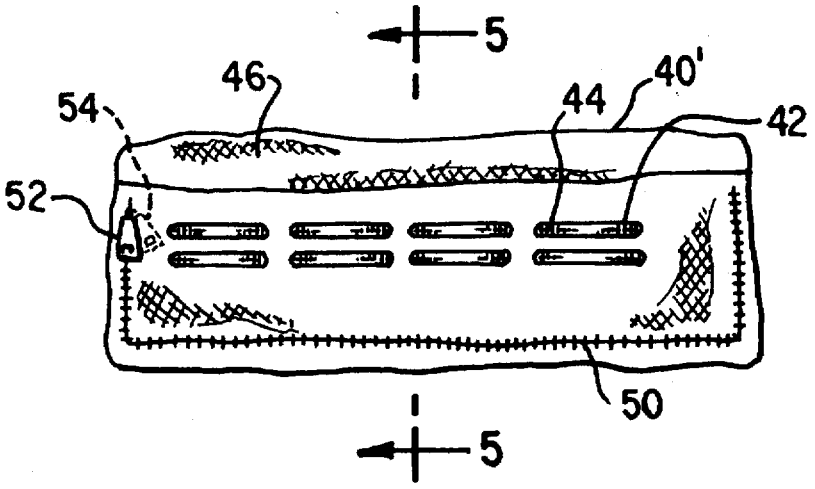
FIG. 4 is an elevation view of an alternate embodiment of the vented cover member of the present invention.
Figure 5:
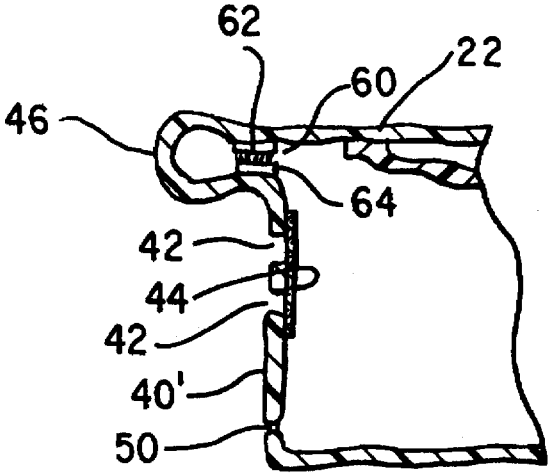
FIG. 5 is a cross-sectional view of the alternate embodiment of the vented cover member taken along the section line 5—5 of FIG. 4.

Referring now to FIGS. 4 and 5, there is shown an alternate configuration of the vented cover member. Vented cover member 40' is provided with a folded portion 46 disposed above the plurality of through openings 42 to form an overhang therefor. The folded portion 46 serves to shield the plurality of ventilation openings 42 from inclement weather, while allowing air to freely circulate through the openings. Additionally, the vented cover member 40' includes a releasable closure extending about at least three sides thereof, such closure being in the form of a zipper 50 having a pull 52 disposed on the external side of cover member 40' and a pull 54 disposed on the interior side thereof. Obviously, other types of releasable coupling mechanisms may be utilized for providing a closeable access to the interior of the sleeping bag enclosure, such as snaps, buttons or hook-and-loop type fastening elements. A mesh screen 44 is provided to overlay the plurality of openings 42, and may be secured to the interior surface of the cover member 40', or alternately secured to the exterior surface.

Figure 6:
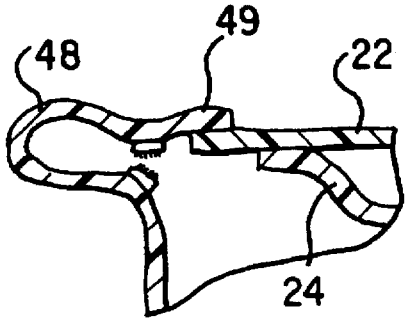
FIG. 6 is a sectional view of an alternate configuration of the embodiment shown in FIG. 5.

The folded portion 46 of vented cover member 40' is maintained as an overhang by means of a fastener assembly 60 having one or more fastening elements 62 coupled to an interior surface of the cover member 40', and one or more second fastening elements 64 coupled to the interior surface of cover member 40' at a location linearly displaced from the location of one or more of the fastening elements 62, such that cover member 40 must be gathered when the elements 62 and 64 are brought into alignment and joined, forming the fold 46. The fastening system 60 may be formed by snap fasteners having cooperating male and female couplings 62, 64, or by strips 62, 64 of hook-and-loop type fastening elements, that cooperate to maintain the folded overhanging portion 46. Alternately, the folded portion 46 may be maintained by replacing the releasable fastening system 60 with stitching to permanently secure portions of the vented cover together to form the folded portion 46. While the vented cover member 40' is shown as being formed from an extension of the outer wall 22, such may be formed by a separate and distinct cover member 48 affixed to the outer wall 22 at a seam 49 as depicted in FIG. 6.

Figure 8:
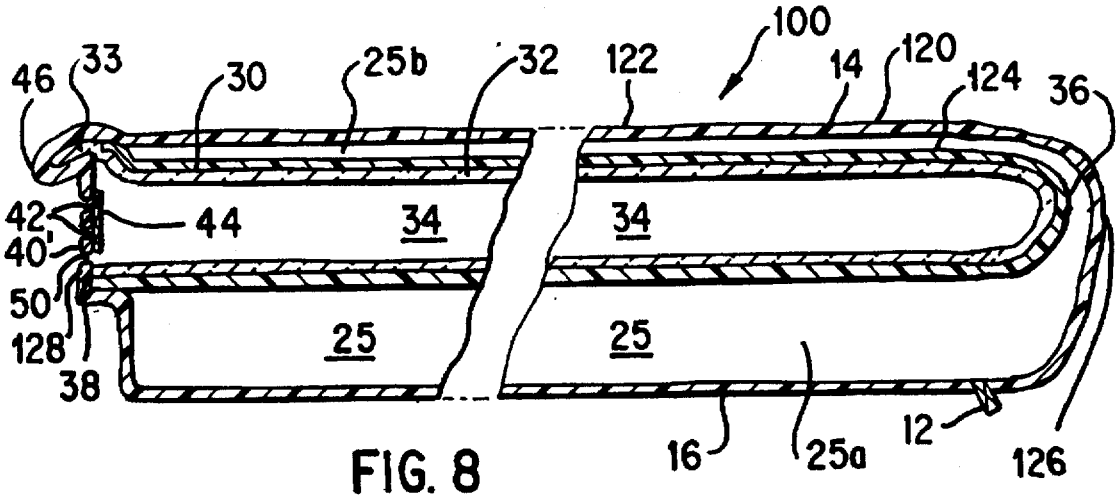
FIG. 8 is a cross-sectional view of another embodiment of the present invention taken along the section line 2—2 of FIG. 1.

Referring now to FIG. 8, there is shown another embodiment of the instant invention. Sleeping bag enclosure 100 is an adaptation of the embodiment shown in FIGS. 2 and 7. Sleeping bag enclosure 100 comprises an outer envelope 120 having a plurality of longitudinally extended air passages 25 formed therein. As in the prior embodiments, air passages 25 are formed between an outer wall 122 and an inner wall 124. Envelope 120 extends longitudinally from a closed end 126 to an open end 128. The sleeping bag enclosure 100 further comprises an inner envelope 30 formed by an insulating material 32, the envelope extending longitudinally from a closed end 36 to an open end 38. Insulating material 32 is bonded to the interior facing surface of inner wall 24, and encompasses an interior space 34 for receiving the user therein.

Figure 9:
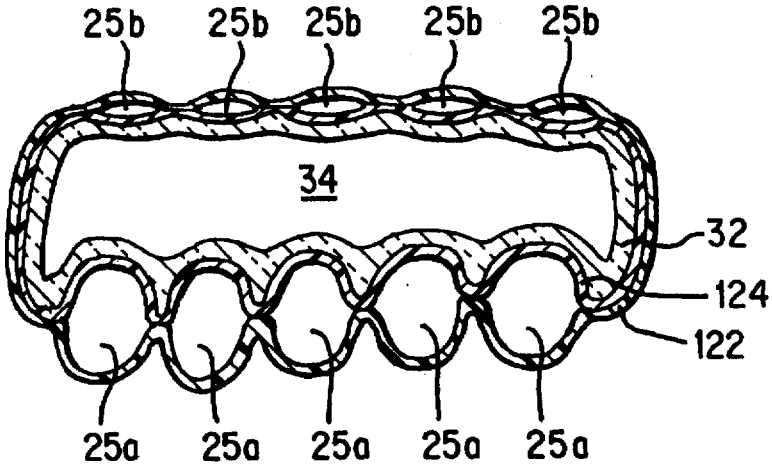
FIG. 9 is a transverse cross-sectional view of the embodiment of FIG. 8 taken along the section line 7—7 of FIG. 1.

Air passage 25 extends from the lower side 16 of envelope 120, around the closed end 26, and across the upper side 14. As shown in FIG. 9, the upper wall 122 and lower wall 124 are bonded at transversely spaced locations in order to form a plurality of substantially parallel air passages. The air passage portions 256 extending across the upper side 14 of envelope 120 are only required to support the weight of the upper portions of walls 122, 124 and 32, while the air passage portion **25*a* extending across the lower side 16 provide for the user's comfort. Thus, the upper air passages 25*b* need not be as large as the lower passages 25*a*. In this embodiment, each of the lower air passage portions 25*a* extending across the lower side 16 of outer envelope 20 are of a larger cross-sectional area than that of each of the respective upper air passage portions 25*b* extending across the upper side 14 of envelope 120. This arrangement provides the further advantage of utilizing less materials to manufacture outer envelope 120, allowing the sleeping bag enclosure 100** to be packed into a smaller and lighter form when being transported by the user.

Referring further to FIG. 8, there is shown an additional means of forming the folded portion 46 of vented cover member 40. The outer wall member 122, or a separate piece of sheet material coupled to outer wall 122, forms vented cover member 40 and may be folded around an extending portion 33 of the insulating sheet material 32 to form the overhang above the plurality of ventilation through openings 42. By this arrangement a stiffer overhanging portion is formed than results from simply forming a fold without the intermediate material portion 33 being present.

Figure 11:
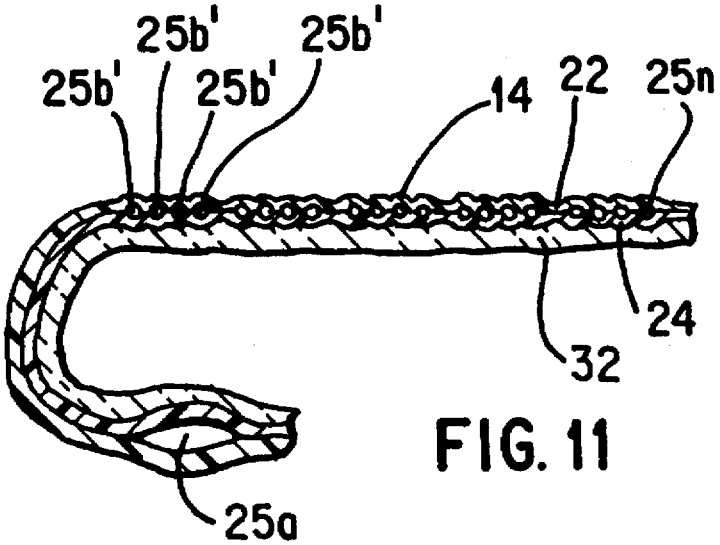
FIG. 11 is a transverse cross-sectional view of an alternate configuration of the present invention.

As the function of the upper air passages **25*b* is to provide structural support to maintain the sleeping bag enclosure in an open condition, other configurations for such air passages may be utilized. One such alternate configuration for the air passages 25*b* is shown in FIG. 11. In this configuration, each air passage 25 is subdivided into groups of a plurality of upper air passages 25*b'*, each group being in fluid communication with a respective lower air passage portion 25*a* to thereby provide greater stiffness to the upper side 14** of the outer envelope.

In each of the embodiments discussed thus far, each of the air passages 25 were formed by selective bonding of the outer wall 22, 22', 122 with the inner wall 24, 24', 124, requiring the material of such outer and inner walls to be impervious to air. While such arrangement is the most efficient, minimizing weight and bulk and facilitating manufacture of the sleeping bag enclosure, in some instances it may be desirable to form the outer and inner walls of other materials which are not impervious to air. In such cases, the inner and outer walls are joined in the same configuration as has been described for creating the air passages, however, such spaces are adapted to receive an inflatable bladder having an air valve coupled thereto, the air valve passing through an aperture formed in the outer wall of such sleeping bag enclosure.

Figure 12:
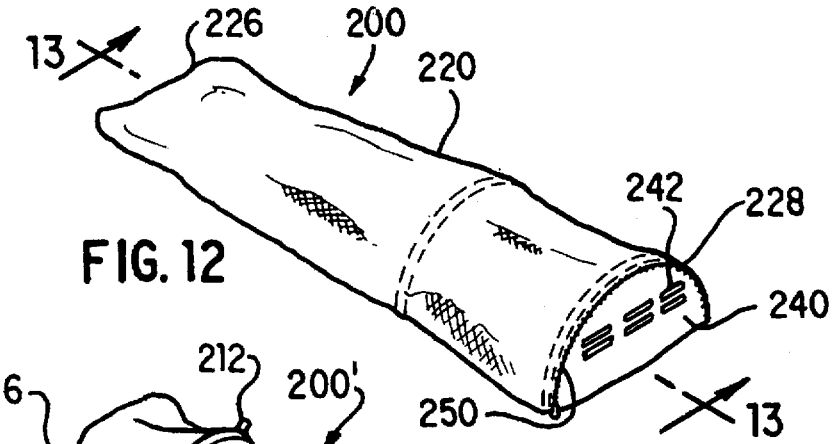
FIG. 12 is a perspective view of another embodiment of the present invention.
Figure 13:
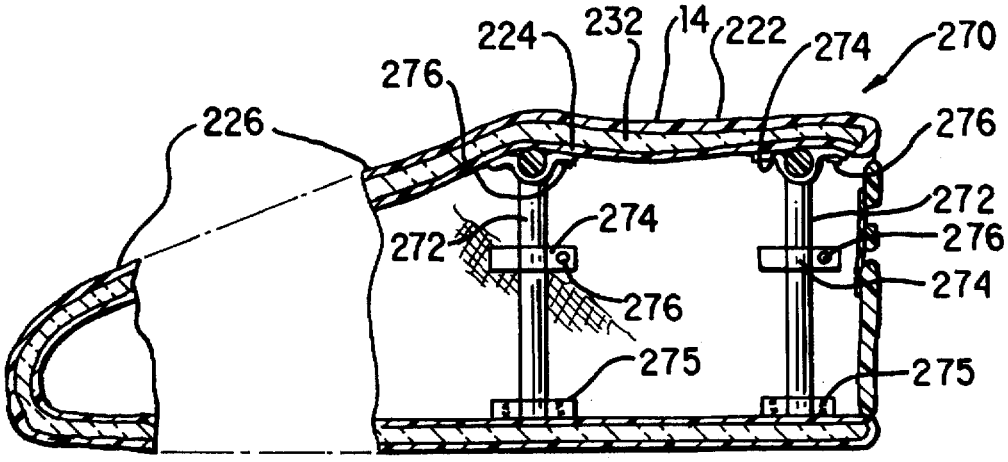
FIG. 13 is a cross-sectional view taken along the section line 13—13 of FIG. 12.

Turning now to FIG. 12, there is shown, the sleeping bag enclosure 200 comprising an envelope 220 having one open end with a vented cover member 240 releasably coupled thereto. Vented cover member 240 is provided with a plurality of ventilation openings 242 formed therethrough. As shown in FIG. 13, the envelope 242 is formed by a pair of inner and outer walls 222 and 224 between which is disposed an insulating layer 232. The envelope 222 is maintained in an open condition by means of a support assembly 270.

Support assembly 270 includes a plurality of flexible support members 272 coupled to the inner wall 224 of the envelope 220. Support members 272 are formed by flexible rod members which may be made from wood, plastic or metal compositions. As weight is a consideration, materials such as Fiberglass-reinforced plastics are particularly suitable for this application. Each of the plurality of flexible support members 272 extend between opposing sides of the envelope 220, the opposing ends thereof being captured within a respective open loop 275. Spaced across the upper side 14 of envelope 220, the inner wall 224 is provided with a plurality of strap members 274 having a fastener 276 disposed on one end thereof for releasable coupling of strap member 274 over the flexible support member 272, for positionally retaining the support member in an arcuate contour across the upper side 14 of envelope 220. Thus, the retention of the support members 272 in an arcuate contour maintains the envelope 220 in an open condition, allowing the user to be comfortably totally enclosed within the envelope 220.

Figure 14:
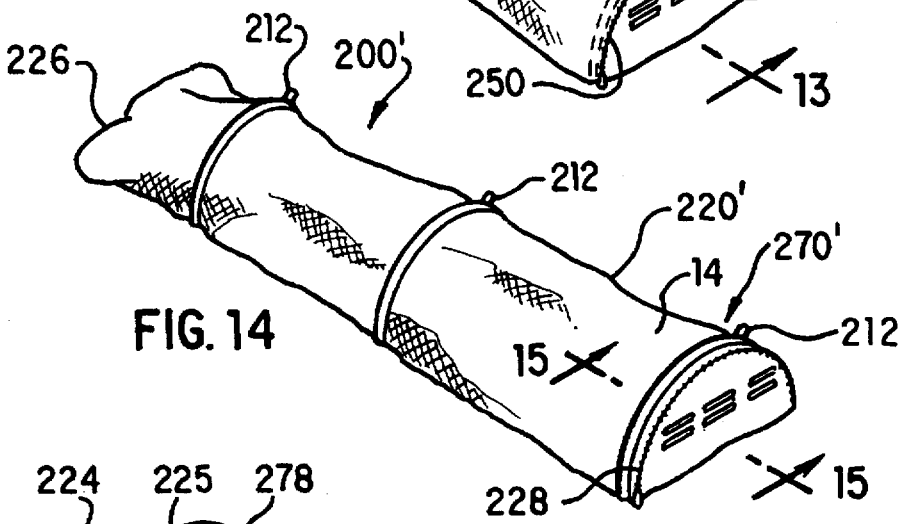
FIG. 14 is a perspective view of another embodiment of the present invention.
Figure 15:
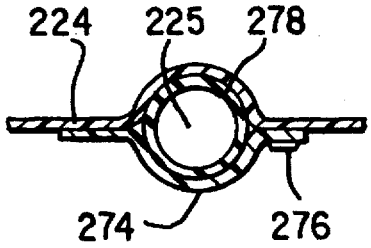
FIG. 15 is a sectional view taken along the section line 15—15 of FIG. 14; and, FIG. 16 is a sectional view of an alternate configuration of the embodiment shown in FIG. 15 of the present invention.

Turning now to FIG. 14, there is shown a sleeping bag enclosure 200' using an alternate configuration of the support assembly to maintain the envelope structure in an open condition. Sleeping bag enclosure 200' includes an envelope 220' maintained in an open condition by means of an inflatable support assembly 270'. Support assembly 270' includes a plurality of inflatable support members 278, as shown in FIG. 15. Each support member 278 being defined by an inflatable bladder that extends between opposing sides of the envelope 220'. The inflatable support members 278 are secured to the envelope 220' in the same manner as described for the embodiment of FIGS. 12 and 13. Each inflatable support member is secured by means of open loops 275 for retaining the opposing ends of the inflatable support member 278 and a plurality of intermediate strap member 274 having fasteners 276 for securing the strap member 274 about the support member 278 and releasably coupling the free end thereof to the inner wall 224.

Figure 16:
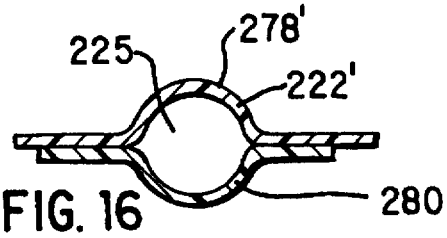

Alternately, as shown in FIG. 16, the inflatable support structure for sleeping bag enclosure 200' may be integrally formed in either the outer or inner wall thereof. Where such is formed in the outer wall, the outer wall 222' is formed of an air-impervious material having transversely directed wall members 280 bonded thereto to form an air passage 225 which extends across the upper side 14 of the envelope 220'. A plurality of such air passages 225 are arranged in longitudinally spaced relationship, each having an air valve 212 fluidly coupled thereto to permit the inflation and deflation thereof. By such arrangement, an integrally formed inflatable support structure maintains the envelope 220' in an open condition to permit the user to be comfortably enclosed therein.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A sleeping bag enclosure, comprising:

a longitudinally extended outer envelope open on one end and having an upper side and a lower side, said upper side having an inner wall and an outer wall formed of an air impervious material and joined together to form a plurality of air passages therebetween for maintaining said outer envelope in an open condition, said lower side being formed by a second outer wall;

an insulating inner envelope open on one end and concentrically disposed within said outer envelope, said inner envelope having an upper side secured to said inner wall and a lower side secured to said second outer wall; and, a vented cover member coupled to said outer wall on a perimeter of said open end for forming a closure therefor.

2. The sleeping bag enclosure as recited in claim 1 where said vented cover member includes at least one ventilation opening formed therethrough.

3. The sleeping bag enclosure as recited in claim 2 where said vented cover member includes a mesh screen overlaying said at least one ventilation opening.

4. The sleeping bag enclosure as recited in claim 2 where said vented cover member has a folded portion disposed above and overhanging said ventilation opening.

5. The sleeping bag enclosure as recited in claim 4 where said folded portion of said vented cover member is formed by securing a respective portion thereof to an extending portion of said upper side portion of said inner envelope.

6. The sleeping bag enclosure as recited in claim 4 where said folded portion of said vented cover member is formed by securing respective portions of an inner surface of said vented cover member together.

7. The sleeping bag enclosure as recited in claim 6 where said respective portions of an inner surface of said vented cover member are secured by means of hook and loop type fasteners.

8. The sleeping bag enclosure as recited in claim 6 where said respective portions of an inner surface of said vented cover member are secured by means of snap type fasteners.

9. The sleeping bag enclosure as recited in claim 1 where said plurality of air passages extend in a direction transverse said longitudinal direction.

10. The sleeping bag enclosure as recited in claim 1 where said plurality of air passages extend in said longitudinal direction.

11. An sleeping bag enclosure, comprising:

a longitudinally extended outer envelope open on one end and having an inner wall and an outer wall formed of an air impervious material, said inner and outer walls being joined together to form a plurality of air passages therebetween and extending from a lower side of said outer envelope to an upper side thereof;

an insulating inner envelope open on one end, said inner envelope being concentrically disposed within said outer envelope and secured to said inner wall of said outer envelope; and, a vented cover member coupled to said outer wall on a perimeter of said open end for forming a closure therefore.

12. The sleeping bag enclosure as recited in claim 11 where each of said plurality of air passages has a first cross-sectional area along said upper side of said outer envelope and a second cross-sectional area along said lower side of said outer envelope, said first cross-sectional area being smaller than said second cross-sectional area.

13. The sleeping bag enclosure as recited in claim 11 where said vented cover member includes at least one ventilation opening formed therethrough.

14. The sleeping bag enclosure as recited in claim 13 where said vented cover member includes a mesh screen overlaying said at least one ventilation opening.

15. The sleeping bag enclosure as recited in claim 13 where said vented cover member has a folded portion disposed above and overhanging said ventilation opening.

16. The sleeping bag enclosure as recited in claim 15 where said folded portion of said vented cover member is formed by securing a respective portion thereof to an extending portion of an upper side portion of said inner envelope.

17. The sleeping bag enclosure as recited in claim 15 where said folded portion of said vented cover member is formed by securing respective portions of an inner surface of said vented cover member together.

18. The sleeping bag enclosure as recited in claim 15 where said respective portions of an inner surface of said vented cover member are secured by means of hook and loop type fasteners.

19. The sleeping bag enclosure as recited in claim 15 where said respective portions of an inner surface of said vented cover member are secured by means of snap type fasteners.

* * * * *